US011614230B2

(12) United States Patent
Faler et al.

(10) Patent No.: US 11,614,230 B2
(45) Date of Patent: Mar. 28, 2023

(54) ABATEMENT SYSTEMS INCLUDING AN OXIDIZER HEAD ASSEMBLY AND METHODS FOR USING THE SAME

(71) Applicant: CORNING INCORPORATED, Corning, NY (US)

(72) Inventors: James Henry Faler, Wilmington, NC (US); Michael Kevin Gilgo, Hampstead, NC (US); Kenneth James Kelmer, Wilmington, NC (US); Amanda N Rand, Hampstead, NC (US)

(73) Assignee: Corning Incorporated, Corning, NY (US)

( * ) Notice: Subject to any disclaimer, the term of this patent is extended or adjusted under 35 U.S.C. 154(b) by 789 days.

(21) Appl. No.: 16/592,152

(22) Filed: Oct. 3, 2019

(65) Prior Publication Data

US 2020/0116353 A1 Apr. 16, 2020

Related U.S. Application Data

(60) Provisional application No. 62/744,427, filed on Oct. 11, 2018.

(51) Int. Cl.

| | |
|---|---|
| ***F23G 5/12*** | (2006.01) |
| ***F23G 5/44*** | (2006.01) |
| ***F23G 7/06*** | (2006.01) |

(52) U.S. Cl.

CPC ..... *F23G 5/12* (2013.01); *F23G 5/442* (2013.01); *F23G 7/065* (2013.01); (Continued)

(58) Field of Classification Search

CPC . F23G 5/12; F23G 5/442; F23G 7/065; F23G 2203/401; F23G 2203/403; F23G 2207/00; F23G 2209/14; F23G 2209/142

See application file for complete search history.

(56) References Cited

U.S. PATENT DOCUMENTS 4,555,389 A * 11/1985 Soneta ..... F23D 14/82 423/337

4,801,437 A 1/1989 Konagaya et al.

(Continued)

FOREIGN PATENT DOCUMENTS

CA 2117605 A1 9/1993
CA 2354520 A1 7/2000

(Continued)

OTHER PUBLICATIONS

International Search Report and Written Opinion of the Euopean International Searching Authority; PCT/US2019/054471; dated Jan. 21, 2020; 11 Pgs.

*Primary Examiner* — David J Laux

(74) *Attorney, Agent, or Firm* — Kevin L. Bray

(57) ABSTRACT

An oxidizer head assembly includes a head body defining an inlet flange, an outlet flange, and a wall, where the inlet flange, the outlet flange, and the wall define a cavity positioned between the inlet flange and the outlet flange, a plurality of nozzles extending through the cavity, a fuel inlet in communication with the plurality of nozzles, where a fuel passes through the fuel inlet and the plurality of nozzles, a shield gas inlet in communication with the cavity, and a porous diffuser plate extending across the outlet opening, the porous diffuser plate including apertures for the plurality of nozzles and a plurality of pores, where a shield gas passes through the shield gas inlet, through the cavity, and through the plurality of pores of the porous diffuser plate around the plurality of nozzles.

14 Claims, 5 Drawing Sheets

(52) U.S. Cl.
CPC .. *F23G 2203/401* (2013.01); *F23G 2203/403* (2013.01); *F23G 2207/00* (2013.01); *F23G 2209/14* (2013.01)

(56) References Cited

U.S. PATENT DOCUMENTS

| | | | | |
|---|---|---|---|---|
| 5,510,093 | A * | 4/1996 | Bartz | F23D 14/16 423/245.3 |
| 6,199,364 | B1 | 3/2001 | Kendall et al. | |
| 2003/0061991 | A1 | 4/2003 | Mattson et al. | |
| 2015/0362182 | A1* | 12/2015 | Bertram | F23G 5/10 432/24 |
| 2017/0122555 | A1* | 5/2017 | Owens | F23D 14/18 |
| 2018/0259182 | A1* | 9/2018 | Silberstein | F23D 14/145 |

FOREIGN PATENT DOCUMENTS

| | | | |
|---|---|---|---|
| DE | 69322622 | T2 | 5/1999 |
| EP | 628146 | B1 | 12/1998 |
| WO | 2003/018866 | A1 | 3/2003 |

* cited by examiner

ABATEMENT SYSTEMS INCLUDING AN OXIDIZER HEAD ASSEMBLY AND METHODS FOR USING THE SAME

This application claims the benefit of priority to U.S. Provisional Application Ser. No. 62/744,427 filed on Oct. 11, 2018, the content of which is relied upon and incorporated herein by reference in its entirety.

FIELD

The present disclosure relates generally relates to abatement systems, and in particular, to abatement systems including an oxidizer head assembly.

TECHNICAL BACKGROUND

In various manufacturing processes, various chemicals may be utilized that must be treated or abated before being released to the environment. As one example, additives, such as silicon tetrafluoride ($SiF_4$) may be used in the production of optical quality glass. In particular, $SiF_4$ may be used to dope blanks of silica-based glass to reduce the refractive index of the glass. However, $SiF_4$ may not generally be discharged to the environment after the doping process, but must be treated in accordance with the environmental regulations of an associated jurisdiction.

Conventional fluorine abatement processes utilized to abate $SiF_4$ may include "wet" treatment processes that may be costly and may produce liquid waste. The liquid waste resulting from these conventional processes may be unsuitable for some municipal water systems, and instead may require further processing before being dispensed or may need to be stored, thereby increasing operating costs.

Accordingly, a need exists for alternative abatement processes and apparatuses for abating chemicals such as $SiF_4$.

SUMMARY

In one embodiment, an oxidizer head assembly includes a head body defining an inlet flange, an outlet flange positioned opposite the inlet flange, and a wall extending between the inlet flange and the outlet flange, where the inlet flange, the outlet flange, and the wall define a cavity positioned between the inlet flange and the outlet flange, the cavity being bounded by the inlet flange and the wall and defining an outlet opening at the outlet flange, a plurality of nozzles extending through the cavity between the inlet flange and the outlet flange and through the outlet opening, a fuel inlet in communication with the plurality of nozzles, where a fuel passes through the fuel inlet and the plurality of nozzles, a shield gas inlet in communication with the cavity, and a porous diffuser plate extending across the outlet opening, the porous diffuser plate including apertures for the plurality of nozzles and a plurality of pores, where a shield gas passes through the shield gas inlet, through the cavity, and through the plurality of pores of the porous diffuser plate around the plurality of nozzles.

In another embodiment, an abatement system includes an oxidizer head assembly including a head body defining an inlet flange, an outlet flange positioned opposite the inlet flange, and a wall extending between the inlet flange and the outlet flange, where the inlet flange, the outlet flange, and the wall define a cavity positioned between the inlet flange and the outlet flange, the cavity being bounded by the inlet flange and the wall and defining an outlet opening defined by the outlet flange, a plurality of nozzles extending through the cavity between the inlet flange and the outlet flange, a fuel inlet in communication with the plurality of nozzles, a shield gas inlet in communication with the cavity, and a porous diffuser plate extending across the outlet opening, the porous diffuser plate including apertures for the plurality of nozzles and a plurality of pores, where a shield gas passes through the shield gas inlet, through the cavity, and through the plurality of pores of the porous diffuser plate around the plurality of nozzles and a fuel passes through the plurality of nozzles, a burner plenum coupled to the outlet flange and in communication with the oxidizer head assembly, the burner plenum defining a burner cavity, and an oxidizer gas inlet coupled to and in communication with the burner plenum, where a process gas passes through the oxidizer gas inlet and the plurality of nozzles into the burner plenum.

In yet another embodiment, a method for abating silicon tetrafluoride includes passing a process gas including silicon tetrafluoride into a burner plenum, passing a fuel through a plurality of nozzles that extend through a cavity of an oxidizer head assembly and through a porous diffuser plate, passing a shield gas through the cavity of the oxidizer head assembly and through a plurality of pores of the porous diffuser plate, and combusting the fuel and the process gas to form resultants including hydrogen fluoride and silicon dioxide.

Additional features of abatement systems and method for using abatement systems described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
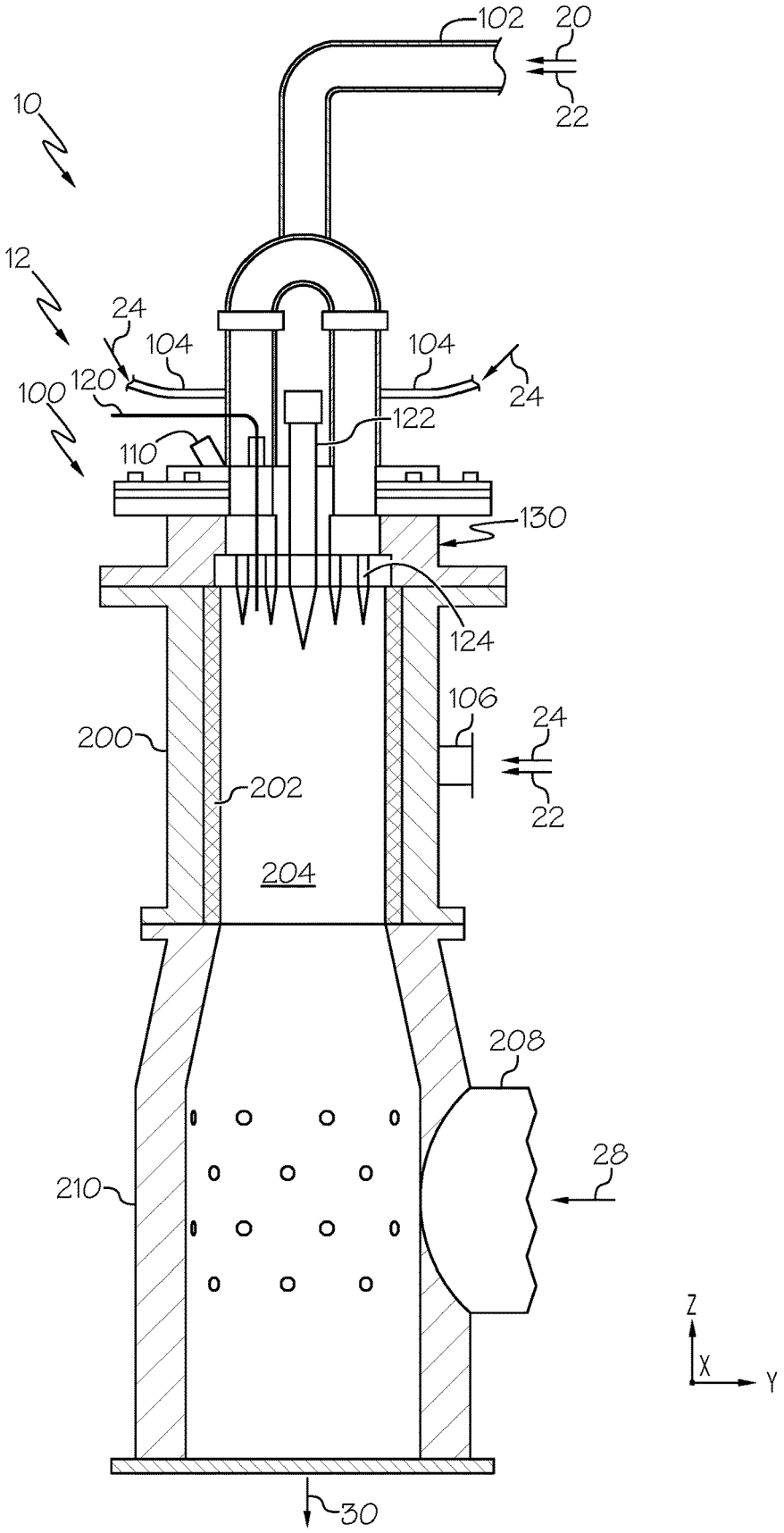
FIG. 1 schematically depicts a section view of an abatement system, according to one or more embodiments shown and described herein.

Reference will now be made in detail to embodiments of abatement systems, examples of which are illustrated in the accompanying drawings. Whenever possible, the same reference numerals will be used throughout the drawings to refer to the same or like parts.

Embodiments of the present disclosure are generally directed to abatement systems including an oxidizer system. The oxidizer system generally includes an oxidizer head assembly coupled to a burner plenum, and the oxidizer head assembly generally combusts reactants within the burner plenum in a combustion reaction. Thermal energy generated by the combustion of the reactants may require the burner plenum to be insulated from components of the oxidizer head assembly to maintain the oxidizer head assembly at an acceptable operating temperature. Additionally, in some combustion reactions, resultants from the combustion reaction may buildup on components of the oxidizer head assembly, such that the oxidizer head assembly must be periodically removed from service for maintenance to remove the buildup of the resultants.

Oxidizer head assemblies according to embodiments described herein generally include a porous diffuser plate through which a shield gas may be passed. The shield gas may act to thermally insulate the oxidizer head assembly from the combustion reaction in the burner plenum. Furthermore, the shield gas may act to bias resultants of the combustion reaction away from the oxidizer head assembly, which may assist in reducing downtime of the oxidizer system, thereby reducing operating costs.

As used herein, the term "longitudinal direction" refers to the forward-rearward direction of the components of the abatement system (i.e., in the +/−X-direction as depicted). The term "lateral direction" refers to the cross-wise direction of the components of the abatement system (i.e., in the +/−Y-direction as depicted), and is transverse to the longitudinal direction. The term "vertical direction" refers to the upward-downward direction of the components of the abatement system (i.e., in the +/−Z-direction as depicted).

Referring initially to FIG. 1, a section view of an abatement system 10 is schematically depicted. The abatement system 10 generally includes an oxidizer assembly 12 including an oxidizer head assembly 100, a burner plenum 200 coupled to the oxidizer head assembly 100, and a quench chamber 210 coupled to the burner plenum 200. While the embodiment depicted in FIG. 1 shows the oxidizer head assembly 100, the burner plenum 200, and the quench chamber 210 linearly arranged in the vertical direction, it should be understood that the oxidizer head assembly 100, the burner plenum 200, and the quench chamber 210 may be arranged in any suitable manner.

The oxidizer assembly 12 includes an oxidizer gas inlet 102 and a plenum inlet 106 in communication with the burner plenum 200, through which a process gas 20 and a combustion gas 22 are passed to the burner plenum 200. The oxidizer gas inlet 102 is in communication with the burner plenum 200 through the oxidizer head assembly 100, while the plenum inlet 106 may be in direct communication with the burner plenum 200. The process gas 20 is generally routed through the oxidizer gas inlet 102 to the oxidizer head assembly 100, and may generally include gas from a manufacturing process that must be treated before being exhausted to the environment. For example, in some embodiments, the abatement system 10 may be incorporated within a glass manufacturing system, and the process gas 20 may include gases from the glass manufacturing process.

In one example, the abatement system 10 is incorporated within a consolidation operation of a glass manufacturing process. Glass blanks that are used to make optical fiber can be fabricated using a vertical axis deposition (VAD) process, an outside vapor deposition (OVD) process, or the like, in which layers of glass are built on top of one another. After deposition, the glass blank may exist as a "soot" body of a porous matrix of silica particles that has a milky, opaque appearance. The soot body may be dried and consolidated to remove internal voidage and moisture, resulting in a clear glass rod which can subsequently be drawn into optical fiber.

During consolidation, the soot body may be placed inside a consolidation furnace, and the consolidation furnace may heat the soot body above the sintering temperature of the glass. Chemicals such as helium and/or chlorine may be applied to the glass blank during consolidation to remove impurities and reduce the water content of the glass. In some processes, silicon tetrafluoride ($SiF_4$) may be applied to the glass blank during the consolidation process to reduce the refractive index of the glass blank. $SiF_4$ from the consolidation process may not be generally suitable for release to the environment, and is an example of a process gas that may instead be directed the abatement system 10 for treatment. While description is made herein to the abatement of $SiF_4$, the abatement system 10 may be used to process any suitable chemical for release to the environment. Other process gases may include $SiCl_4$, CO, $O_2$, $SF_6$, and $Cl_2$. Process gases may be accompanied by inert or unreactive gases (e.g. He, Ar, air, $N_2$).

The combustion gas 22 may include heated "make-up" gas, for example $O_2$ and air, that is vented to the burner plenum 200 through the oxidizer gas inlet 102 and/or the plenum inlet 106 to supplement the process gas 20. For example, in some embodiments, it is desirable to have a constant or near constant volumetric flow of gas to the burner plenum 200 to move the process gas 20 through the burner plenum 200 at a constant or near constant velocity and support a combustion reaction of the process gas 20 in the burner plenum 200, as described in greater detail herein. One or more detection devices, such as flowmeters or the like, may be positioned on and/or engaged with the oxidizer gas inlet 102 and/or plenum inlet 106. Based on a detected flow of the process gas 20 through the oxidizer gas inlet 102, more or less combustion gas 22 may be vented to the burner plenum 200 through the oxidizer gas inlet 102 and/or the plenum inlet 106 to maintain a constant or near constant total predetermined volumetric flow of process gas 20 and combustion gas 22 directed to the burner plenum 200. For example, in response to detecting a decrease in the volumetric flow of process gas 20 to the burner plenum 200, the volumetric flow of combustion gas 22 directed to the burner plenum 200 may be increased. In response to detecting an increase in the volumetric flow of process gas 20 to the burner plenum 200, the volumetric flow of combustion gas 22 directed to the burner plenum 200 may decreased. In one embodiment, the total predetermined volumetric flow of combustion gas 22 and process gas 20 flowing to the burner plenum 200 is maintained between 0.100 cubic meters per minute and 2.000 cubic meters per minute, inclusive of the endpoints. In another embodiment, the predetermined volumetric flow of combustion gas 22 and process gas 20 flowing to the burner plenum 200 is maintained at about 0.595 cubic meters per minute.

The oxidizer head assembly 100 of the oxidizer assembly 12 includes a fuel inlet 104 that is in communication with the one or more nozzles 124 that extend through the oxidizer head assembly 100 to the burner plenum 200. A fuel 24 may be passed through the fuel inlet 104 and nozzles 124 and ignited in the burner plenum 200. In some embodiments, fuel 24 may also be passed to the burner plenum 200 through the plenum inlet 106. Combustion of the fuel 24 may oxidize components of the process gas 20, as described in greater detail herein. In embodiments, the fuel 24 may include a petroleum-based fuel, such as natural gas, a hydrocarbon or the like. The one or more nozzles 124 may also be in communication with the oxidizer gas inlet 102 such that process gas 20 and combustion gas 22 may be mixed with the fuel 24 within the oxidizer head assembly 100 and fed to the burner plenum 200 through the one or more nozzles 124. The process gas 20, the combustion gas 22, and the fuel 24 may be mixed together at a ratio suitable to create a flammable mixture suitable to support a combustion reaction within the burner plenum 200, as described in greater detail herein.

In the embodiment depicted in FIG. 1, the oxidizer head assembly 100 further includes a pilot assembly 122 extending through the oxidizer head assembly 100 to the burner plenum 200. In embodiments, the pilot assembly 122 may operate to ignite the fuel 24 and process gas 20 passing through the nozzles 124 and may include an ignition component, such as a spark electrode or the like, to facilitate the ignition of the fuel 24 and process gas 20. In embodiments, the pilot assembly 122 may also be in communication with the fuel inlet 104, and the fuel 24 may pass through the pilot assembly 122 to be ignited in the burner plenum 200.

In embodiments, the oxidizer head assembly 100 further includes at least one temperature detector 120 extending through the oxidizer head assembly 100 to the burner plenum 200, the temperature detector 120 generally including a device capable of detecting temperature, such as a thermocouple or the like. The temperature detector 120 generally extends at least partially within the burner plenum 200 and detects a temperature at the interface between the oxidizer head assembly 100 and the burner plenum 200. Detected fluctuations in the temperature and/or detected temperatures outside of an expected operation range may be indicative of issues with the oxidizer assembly 12, such as blockages in one or more of the nozzles 124, the buildup of resultants on the oxidizer head assembly 100 and/or the burner plenum 200, or the like. Accordingly, the temperature detector 120 may be utilized to monitor the operation of the oxidizer assembly 12.

In some embodiments, the oxidizer assembly 12 further includes a view glass 110 extending through the oxidizer head assembly 100 to the burner plenum 200. The view glass 110 may be formed of glass or another material suitable to allow a user to view the burner plenum 200 and monitor the operation of the oxidizer assembly 12.

The burner plenum 200 is coupled to and is in communication with the oxidizer head assembly 100 and generally defines a burner cavity 204 positioned within the burner plenum 200. The fuel 24 directed to the burner plenum 200 by the nozzles 124 and/or the plenum inlet 106 may be ignited within the burner cavity 204 of the burner plenum 200. In embodiments, the burner plenum 200 includes an insulation layer 202 extending along the burner cavity 204 of the burner plenum 200. The insulation layer 202 may thermally insulate the burner cavity 204, and may be formed of a material suitable for thermal insulation, such as a ceramic or the like. In some embodiments, the insulation layer 202 includes one or more components that assist in initiating and/or sustaining a combustion reaction within the burner plenum 200. For example, in some embodiments, the insulation layer 202 includes one or more radiant burners, such as a DURAHERM burner available from the Alzeta Corporation. The radiant burners of the insulation layer 202 may be formed of a fibrous ceramic or the like that radiates thermal energy within the burner cavity 204 to support a combustion reaction, as described in greater detail herein. In some embodiments, the burner plenum 200 defines an annular cavity surrounding the burner cavity 204, and fuel 24 and combustion gas 22 at an ambient temperature may be provided to the annular cavity of the burner plenum 200, such as from the plenum inlet 106, before passing to the burner cavity 204. The combustion gas 22 and fuel 24 may also thermally insulate the combustion reaction within the burner cavity 204 from the exterior of the burner plenum 200. Thermal blankets or the like may also be selectively positioned on the exterior of the burner plenum 200 to further thermally insulate the exterior of the burner plenum 200 from the combustion reaction within the burner cavity 204.

As described above, process gas 20 and combustion gas 22 are directed to the burner plenum 200 via the oxidizer gas inlet 102 and the plenum inlet 106. In embodiments, the process gas 20 is heated, for example by combusting the fuel 24, and the process gas 20 may undergo a combustion reaction within the burner plenum 200. In embodiments where the process gas 20 includes $SiF_4$, water may be combined with the $SiF_4$ at a high temperature to form hydrogen fluoride (HF) and silicon dioxide ($SiO_2$). The water may be separately provided to the burner plenum 200 or may be provided by water vapor present in the process gas 20 and/or the combustion gas 22. The resultants of the combustion reaction (e.g., HF and $SiO_2$) within the burner plenum 200 may pass from the burner plenum 200 to the quench chamber 210.

In embodiments, the quench chamber 210 is coupled to and in communication with a cooling air inlet 208 through which cooling air 28 may be passed to the quench chamber 210 to cool the resultants of the combustion reaction in the quench chamber 210. In embodiments, the cooling air 28 may include cooled air and/or air at an ambient temperature that lowers the temperature of the resultants passed to the quench chamber 210 from the burner plenum 200. After cooling within the quench chamber 210, the resultants of the combustion reaction may be passed through an exhaust outlet 30 of the quench chamber 210 that is spaced apart from the burner plenum 200. In embodiments in which the resultants include HF and/or $SiO_2$, the resultants may be passed from the quench chamber 210 to a dry scrubber. For example, the resultants may be passed through a calcium carbonate dry scrubber before being released to the environment, such as via a stack.

Figure 2:
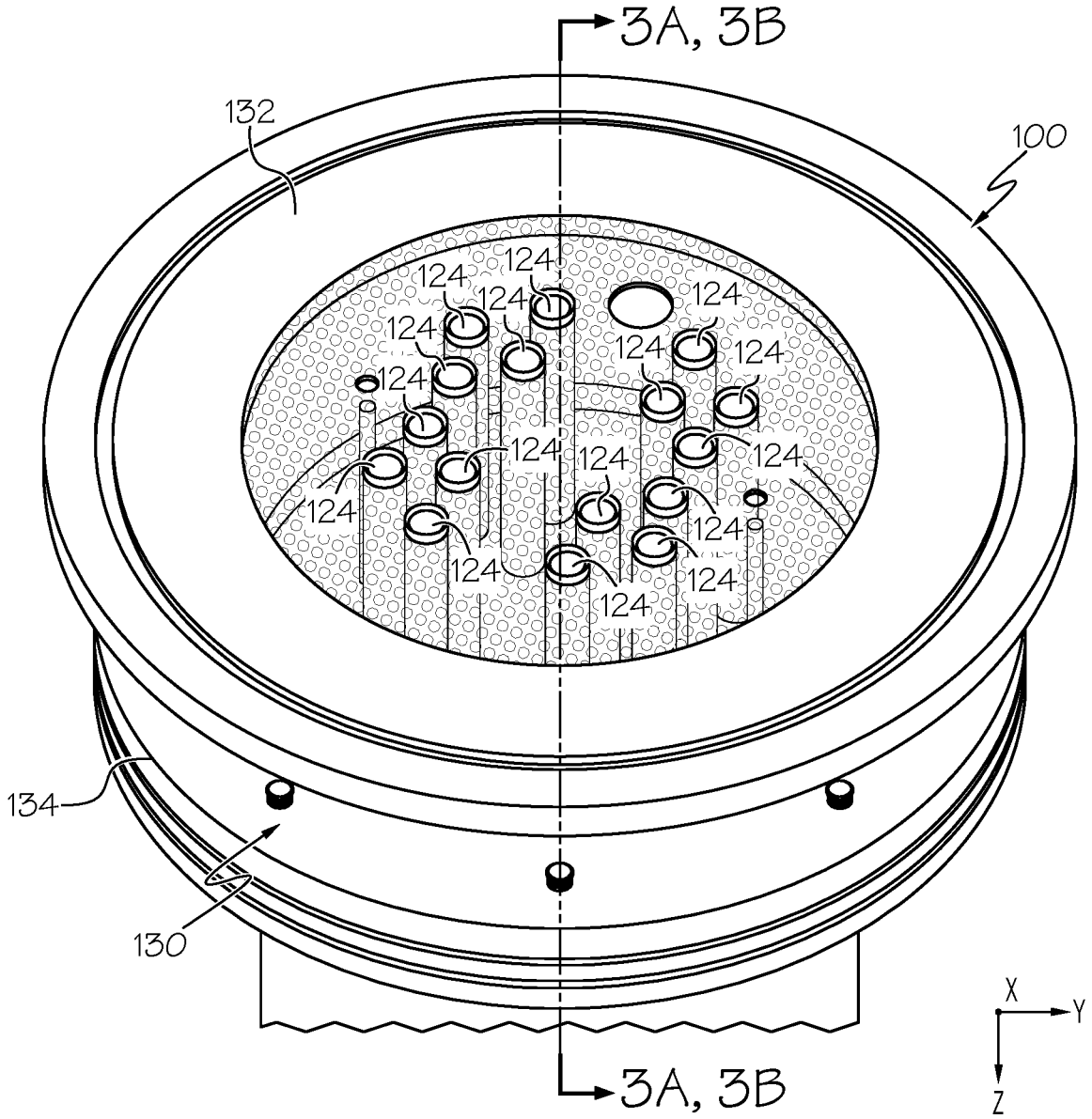
FIG. 2 schematically depicts a bottom perspective view of an oxidizer head assembly of the abatement system of FIG. 1, according to one or more embodiments shown and described herein.

Referring to FIG. 2, a lower perspective view of the oxidizer head assembly 100 is schematically depicted. The oxidizer head assembly 100 generally includes a head body 130 and the plurality of nozzles 124 extending through the head body 130. As described above, the plurality of nozzles 124 are in communication with the fuel inlet 104 (FIG. 1), and the fuel 24 (FIG. 1) may pass through the nozzles 124, being ignited at the end of the nozzles 124. The plurality of nozzles 124 may further be in communication with the oxidizer gas inlet 102 (FIG. 1) and/or the plenum inlet 106 (FIG. 1), such that process gas 20 and/or combustion gas 22 may be passed through the nozzles 124. In the embodiment depicted in FIG. 2, the oxidizer head assembly 100 is depicted as including sixteen separate nozzles 124, however, it should be understood that the oxidizer head assembly 100 may include any suitable number of nozzles 124.

Figure 3A:
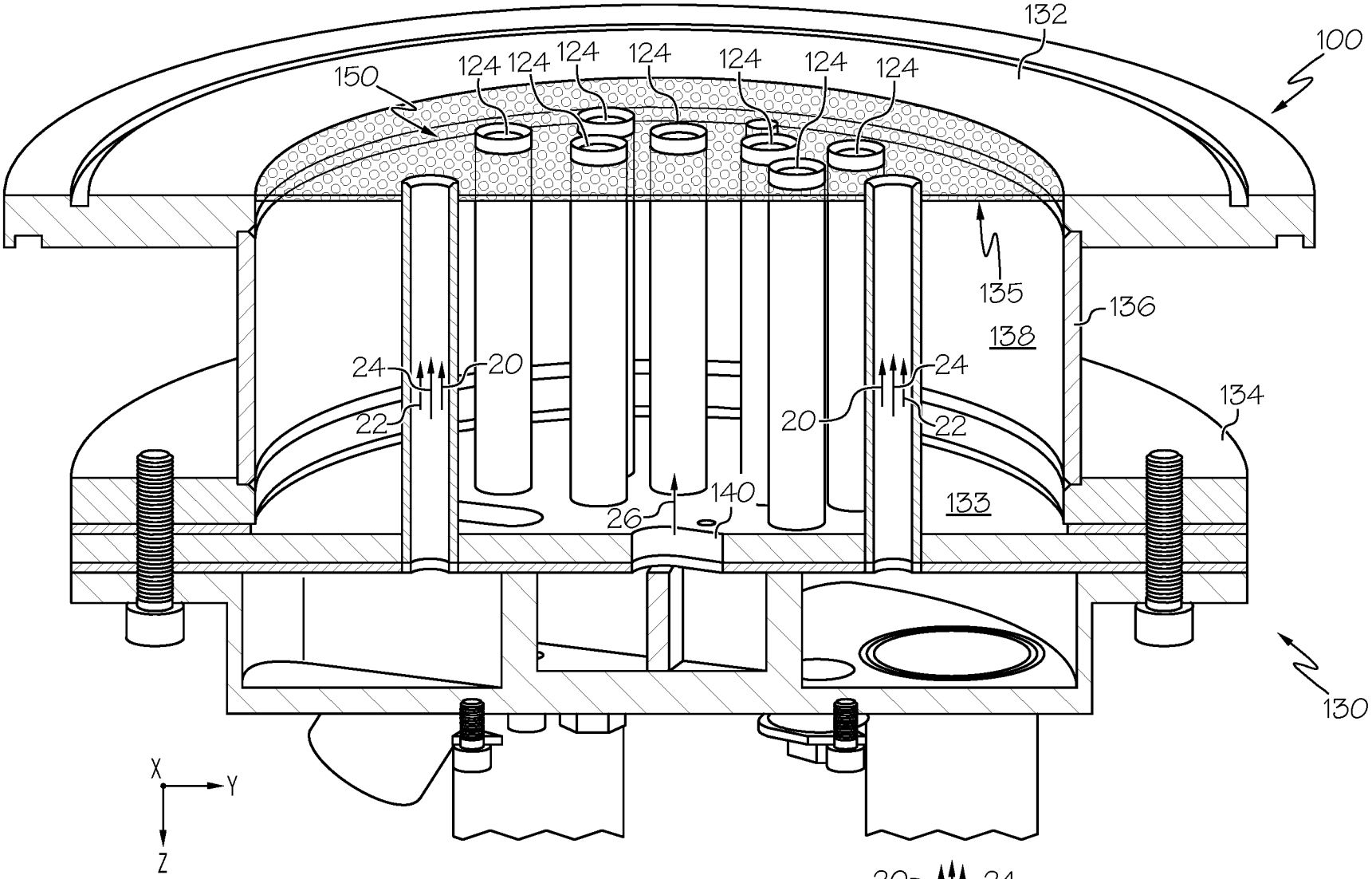
FIG. 3A schematically depicts a section view of the oxidizer head assembly of FIG. 2 along section 3A-3A of FIG. 2, according to one or more embodiments shown and described herein.
Figure 3B:
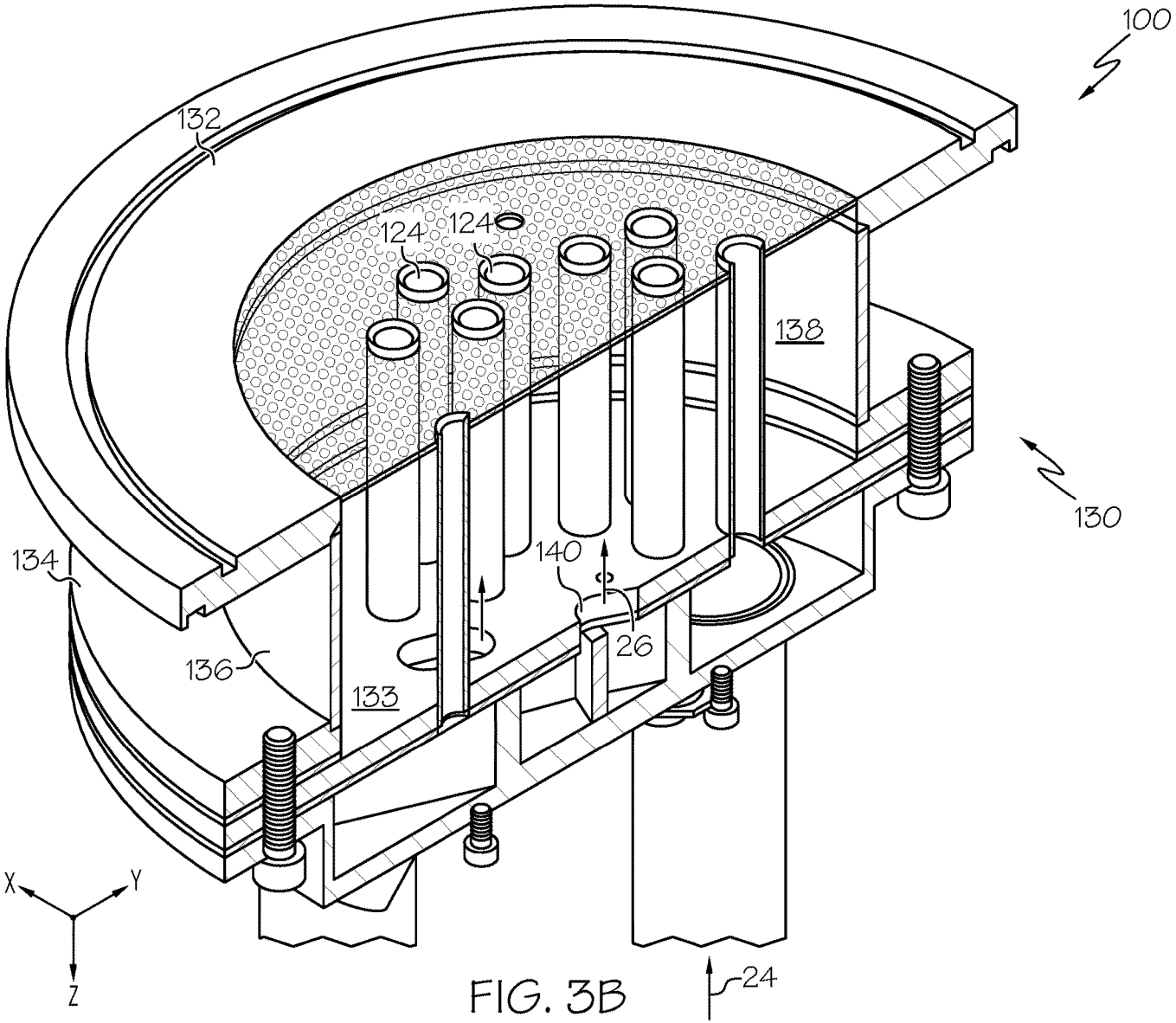
FIG. 3B schematically depicts another section view of the oxidizer head assembly of FIG. 2 along section 3B-3B of FIG. 2, according to one or more embodiments shown and described herein.

Referring collectively to FIGS. 3A and 3B, a front and a perspective section view of the oxidizer head assembly 100 along sections 3A-3A and 3B-3B of FIG. 2 are schematically depicted, respectively. The head body 130 includes an inlet flange 134 and an outlet flange 132 positioned opposite the inlet flange 134 in the vertical direction as depicted. In embodiments, the outlet flange 132 is coupled to the burner plenum 200 (FIG. 1), such that the oxidizer head assembly 100 is in communication with the burner plenum 200.

The head body 130 further includes a wall 136 extending between the inlet flange 134 and the outlet flange 132. In some embodiments, the inlet flange 134, the outlet flange 132, and the wall 136 are integrally formed. In other embodiments, the inlet flange 134, the outlet flange 132, and the wall 136 may be separately formed and coupled to one another to form the oxidizer head assembly 100. Furthermore, while the embodiment depicted in FIGS. 3A and 3B depict the inlet flange 134, the outlet flange 132, and the wall 136 as being cylindrically shaped with the inlet flange 134 and the outlet flange 132 extending outward from the wall 136, it should be understood that the inlet flange 134, the outlet flange 132, and the wall 136 may include any suitable shape.

The inlet flange 134, the outlet flange 132, and the wall 136 define a cavity 138 positioned between the inlet flange 134 and the outlet flange 132, the cavity 138 being bounded by the inlet flange 134 and the wall 136. More particularly, the inlet flange 134 may define a floor 133 oriented to face downward in the vertical direction (i.e., in the −Z-direction as depicted), such that the cavity 138 is bounded by the floor 133 of the inlet flange 134 and the wall 136. The outlet flange 132 defines an outlet opening 135, such that the cavity 138 is open-ended at the outlet flange 132.

In embodiments, the inlet flange 134 defines a shield gas inlet 140 on the floor 133 of the inlet flange 134. A shield gas 26 may be passed through the shield gas inlet 140, through the cavity 138, and out of the oxidizer head assembly 100 at the outlet opening 135. Accordingly, the fuel 24, the combustion gas 22, and the process gas 20, and the shield gas 26 move through the cavity 138 of the oxidizer head assembly 100 and out the outlet opening 135, the fuel 24, the combustion gas 22, and the process gas 20 being separated from the shield gas 26 by the nozzles 124. In other embodiments, the oxidizer gas inlet 102 (FIG. 1) and/or the plenum inlet 106 (FIG. 1) may be in communication with the cavity 138 such that the process gas 20 and/or the combustion gas 22 may also pass through the cavity 138 and the outlet opening 135 as the fuel 24 passes through the nozzles 124. While the embodiment depicted in FIGS. 3A and 3B show the shield gas inlet 140 as being defined by the floor 133 of the inlet flange 134, it should be understood that the shield gas inlet 140 may be positioned at any suitable location of the oxidizer head assembly 100 to provide shield gas 26 to the cavity 138, including, for example, along wall 136.

In embodiments, the shield gas 26 may generally include an inert gas, such as nitrogen, that does not react in the combustion reaction in the burner plenum 200 (FIG. 1). The shield gas 26 may assist in thermally insulating the combustion reaction in the burner plenum 200 (FIG. 1) from the oxidizer head assembly 100. For example, the flow of shield gas 26 moving downward in the vertical direction through the oxidizer head assembly 100 (i.e., in the −Z-direction as depicted) may assist in reducing the amount of thermal energy transmitted from the burner plenum 200 (FIG. 1) upward through the oxidizer head assembly 100. In embodiments, the combustion of the fuel 24 and the combustion reaction in the burner plenum 200 (FIG. 1) may generate significant heat energy such that it is desirable to isolate the heat energy within the burner plenum 200, and thermally isolating the oxidizer head assembly 100 from the burner plenum 200 may assist in maintaining components of the oxidizer head assembly 100 at a suitable operating temperature.

In embodiments, the shield gas 26 may be passed through the cavity 138 at a volumetric flow of between 0.056 cubic meters per minute and 0.170 cubic meters per minute, inclusive of the endpoints. In other embodiments, the shield gas 26 may be passed through the cavity 138 at a volumetric flow of about 0.113 cubic meters per minute. The volume of the flow of the shield gas 26 may be selected to adequately thermally insulate the oxidizer head assembly 100, and may also be selected to prevent the buildup of resultant from the combustive reaction within the burner plenum 200 on the oxidizer head assembly 100, as described in greater detail herein.

In embodiments, the oxidizer head assembly 100 further includes a porous diffuser plate 150 extending over the outlet opening 135. The plurality of nozzles 124 generally extend through the outlet opening 135 and the porous diffuser plate 150 through a plurality of nozzle apertures, as described in greater detail herein. The shield gas 26 flowing through the cavity 138 in the vertical direction generally flows through the porous diffuser plate 150 around the plurality of nozzles 124, as described in greater detail herein. In embodiments in which the process gas 20 and/or the combustion gas 22 flows through the cavity 138 (e.g., instead or in addition to flowing through the nozzles 124), the process gas 20 and/or the combustion gas 22 may also flow through the porous diffuser plate 150.

Figure 4:
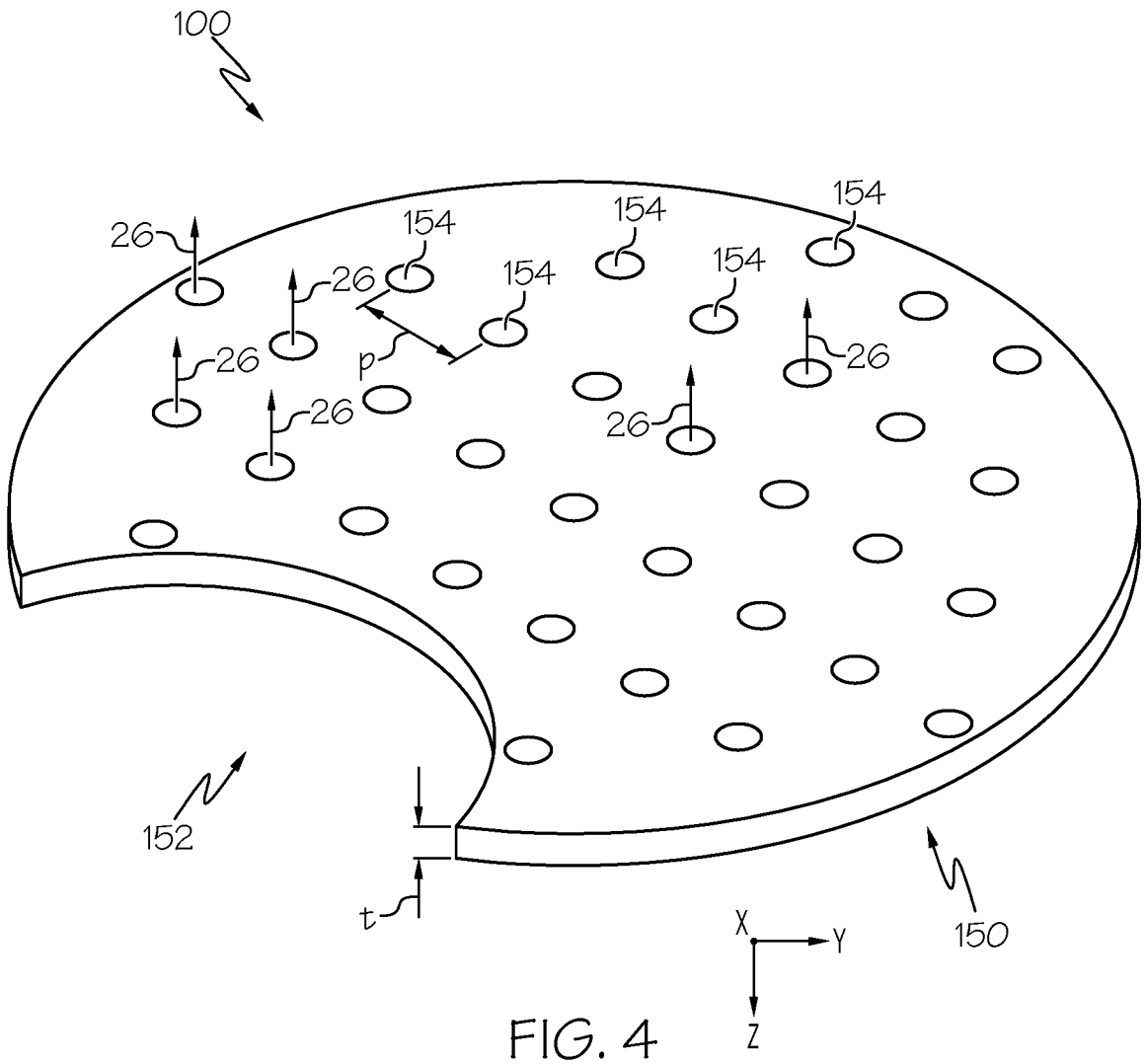
FIG. 4 schematically depicts an enlarged view of porous diffuser plate of the oxidizer head assembly of FIG. 2, according to one or more embodiments shown and described herein.

Referring to FIG. 4, an enlarged view of the porous diffuser plate 150 is schematically depicted. The porous diffuser plate 150 generally includes at least one nozzle aperture 152, and a plurality of pores 154 extending through the porous diffuser plate 150. In embodiments, each of the plurality of nozzles 124 (FIG. 3B) extend through corresponding nozzle apertures 152, and a diameter of each of the nozzle apertures 152 generally corresponds to an outer diameter of each of the nozzles 124. In other words, each of the nozzles 124 (FIG. 3B) may pass through the nozzle apertures 152, and there may be minimal or no clearance between the nozzles 124 and the nozzle apertures 152 such that the nozzles 124 may have an interference fit with corresponding nozzle apertures 152. Because the nozzles 124 (FIG. 3B) may have an interference fit with corresponding nozzle apertures 152, shield gas 26 passing through the porous diffuser plate 150 may primarily pass through the plurality of pores 154, instead of between the nozzle apertures 152 and the nozzles 124. In other embodiments, the diameter of each of the nozzle apertures 152 may be greater than the outer diameter of each of the nozzles 124 (FIG. 3), such that shield gas 26 may pass between the nozzles 124 and the nozzle apertures 152, for example in an annular fashion. In embodiments, the temperature detector 120 (FIG. 1) and the pilot assembly 122 (FIG. 1) also extend through the porous diffuser plate 150 through corresponding apertures.

The plurality of pores 154 generally extend through the porous diffuser plate 150 in the vertical direction and permit the shield gas 26 to pass through the porous diffuser plate 150. In particular, the plurality of pores 154 extends through a thickness "t" of the porous diffuser plate 150 in the vertical direction. In embodiments, the thickness t of the porous diffuser plate 150 is between 10 millimeters (mm) and 15 mm, inclusive of the endpoints. In some embodiments, the thickness t of the porous diffuser plate 150 is about 12.19 mm. In embodiments, the porous diffuser plate 150 may be formed of any suitable material, for example but not limited to steel, stainless steel, sintered metal or the like.

In embodiments, each of the plurality of pores 154 are regularly spaced apart from one another and are positioned throughout the porous diffuser plate 150 (i.e., the plurality of pores 154 extend across the entirety of the porous diffuser plate 150 in the lateral and longitudinal directions as depicted). By positioning the plurality of pores 154 throughout the porous diffuser plate 150, the flow of shield gas 26 through the porous diffuser plate 150 may be generally uniform, which may assist in reducing the buildup of resultant from the combustive reaction in the burner plenum 200 (FIG. 1), as described in greater detail herein. Each of the plurality of pores 154 are separated from one another by a pore pitch "p." The pore pitch p, in some embodiments, may be selected to be at least 3 mm evaluated between the centers of adjacent pores 154. In other embodiments, the pore pitch p is selected to be about 3.175 mm evaluated between the centers of adjacent pores 154. In embodiments, each of the plurality of pores 154 include a diameter of at least 1.50 mm. In some embodiments, each of the plurality of pores 154 include a diameter of about 1.59 mm.

The plurality of pores 154 are defined on the porous diffuser plate 150 such that the plurality of pores 154 comprises at least 20% of the surface area of the porous diffuser plate 150 at portions of the porous diffuser plate 150 including the plurality of pores 154 (e.g., the portions of the porous diffuser plate 150 excluding the nozzle apertures 152 and apertures associated with the temperature detector 120 (FIG. 1) and the pilot assembly 122 (FIG. 1)). In other words, at the portions of the porous diffuser plate 150 excluding the nozzle apertures 152 and apertures associated with the temperature detector 120 (FIG. 1) and the pilot assembly 122 (FIG. 1), the porous diffuser plate 150 includes at least 20% "open area" defined by the plurality of pores 154. In some embodiments, at the portions of the porous diffuser plate 150 including the plurality of pores 154, the porous diffuser plate 150 includes between 20% and 25% open area defined by the plurality of pores 154, inclusive of the endpoints. In other embodiments, at the portions of the porous diffuser plate 150 including the plurality of pores 154, the porous diffuser plate 150 includes about 23% open area defined by the plurality of pores 154.

The diameter of each of the plurality of pores 154, the thickness t of the porous diffuser plate 150, and the open area defined by the plurality of pores 154 may generally be selected to achieve a desired flow of shield gas 26 through the porous diffuser plate 150. Without being bound by theory, the volumetric flow of the shield gas 26 and the geometry of the porous diffuser plate 150 and the plurality of pores 154 affect the flow characteristics (e.g., flow velocity) of the shield gas 26 flowing through the porous diffuser plate 150. The flow characteristics of the shield gas 26 may not only affect the thermal insulation of the oxidizer head assembly 100, but may be selected such that the shield gas 26 inhibits the accumulation of resultants from the combustion reaction on the porous diffuser plate 150 and/or the nozzles 124 (FIG. 3A).

For example and referring again to FIG. 1, in embodiments in which process gas 20 including $SiF_4$ is combusted in the burner plenum 200, HF and $SiO_2$ are produced in the combustion reaction. In such embodiments, $SiO_2$ produced during the combustion reaction may re-circulate upward in the vertical direction, and may accumulate on the oxidizer head assembly 100 and/or along the insulating layer 202 of the burner plenum 200. The accumulation of $SiO_2$ on the oxidizer head assembly 100 and the burner plenum 200 may lower the temperature of the combustion reaction within the burner plenum 200, which may reduce the effectiveness of the oxidizer assembly 12. As one example, the accumulation of $SiO_2$ on the oxidizer head assembly 100 may block the nozzles 124 and/or the pilot assembly 122, thereby reducing the fuel 24 passed through the nozzles 124 and/or the pilot assembly 122 to support the combustion reaction. As such, the accumulation of $SiO_2$ on the oxidizer head assembly 100 may require that the oxidizer head assembly 100 be removed from service to remove the accumulation of $SiO_2$, resulting in decreased productivity and increased production costs. Additionally, the accumulation of $SiO_2$ on the insulating layer 202 may damage the insulating layer 202 such that the insulating layer 202 must be replaced, further decreasing productivity and increasing production costs.

The accumulation of $SiO_2$ on the oxidizer head assembly 100 may also block the temperature detector 120, such that the temperature detector 120 detects an abnormally low temperature and/or is unable to accurately detect a temperature at the interface of the oxidizer head assembly 100 and the burner plenum 200. Inaccurate temperature detection by the temperature detector 120 and/or inoperability of the temperature detector 120 may prevent suitable monitoring of the oxidizer assembly 12, which may also require the oxidizer head assembly 100 to be removed from service to remove the accumulation of $SiO_2$, resulting in decreased productivity and increased production costs.

However and referring again to FIG. 4, the flow of shield gas 26 through the porous diffuser plate 150 may bias resultants (e.g., $SiO_2$) downward and away from the porous diffuser plate 150. By biasing the resultants downward and away from the porous diffuser plate 150, the flow of the shield gas 26 biases the resultants downward and away from the nozzles 124 (FIG. 1) and the temperature detector 120 (FIG. 1), preventing the resultants from building up on the oxidizer head assembly 100. Biasing the resultants away from the oxidizer head assembly 100 may further bias the resultants downward and out of the burner plenum 200 (FIG. 1), thereby reducing the buildup of resultants within the burner plenum 200. By reducing the buildup of resultants on the oxidizer head assembly 100 and the burner plenum 200 (FIG. 1), the flow of the shield gas 26 through the porous diffuser plate 150 may reduce the downtime of the oxidizer assembly 12 and may reduce operating associated with the treatment of $SiF_4$.

Furthermore, because the porous diffuser plate 150 includes the plurality of pores 154 positioned throughout the porous diffuser plate 150, the flow of shield gas 26 through the porous diffuser plate 150 may be generally uniform throughout the porous diffuser plate 150 (e.g., evaluated in the lateral and longitudinal directions as depicted). As such, the shield gas 26 may act to reduce the accumulation of resultants of the combustive reaction across the entirety of the porous diffuser plate 150, which may be more effective at reducing the accumulation of resultants on the oxidizer head assembly 100 and the burner plenum 200 (FIG. 1) as compared to configurations in which shield gas is only passed through the oxidizer head assembly annularly around each of the nozzles 124 (FIG. 1) or at other limited discrete locations of the oxidizer head assembly.

Accordingly, the present disclosure is directed to abatement systems including an oxidizer system. The oxidizer system generally includes an oxidizer head assembly coupled to a burner plenum, and the oxidizer head assembly generally combusts reactants within the burner plenum in a combustion reaction. Thermal energy generated by the combustion of the reactants may require the burner plenum to be insulated from components of the oxidizer head assembly to maintain the oxidizer head assembly at an acceptable operating temperature. Additionally, in some combustion reactions, resultants from the combustion reaction may buildup on components of the oxidizer head assembly, such that the oxidizer head assembly must be periodically removed from service for maintenance to remove the buildup of the resultants.

Oxidizer head assemblies according to embodiments described herein generally include a porous diffuser plate through which a shield gas may be passed. The shield gas may act to thermally insulate the oxidizer head assembly from the combustion reaction in the burner plenum. Furthermore, the shield gas may act to bias resultants of the combustion reaction away from the oxidizer head assembly, which may assist in reducing downtime of the oxidizer system, thereby reducing operating costs.

Aspect 1 of the description is:

An oxidizer head assembly comprising:

a head body defining:

an inlet flange;

an outlet flange positioned opposite the inlet flange; and a wall extending between the inlet flange and the outlet flange, wherein the inlet flange, the outlet flange, and the wall define a cavity positioned between the inlet flange and the outlet flange, the cavity being bounded by the inlet flange and the wall and defining an outlet opening at the outlet flange;

a plurality of nozzles extending through the cavity between the inlet flange and the outlet flange and through the outlet opening;

a fuel inlet in communication with the plurality of nozzles, wherein a fuel passes through the fuel inlet and the plurality of nozzles;

a shield gas inlet in communication with the cavity; and a porous diffuser plate extending across the outlet opening, the porous diffuser plate comprising apertures for the plurality of nozzles and a plurality of pores, wherein a shield gas passes through the shield gas inlet, through the cavity, and through the plurality of pores of the porous diffuser plate around the plurality of nozzles.

Aspect 2 of the description is:

The oxidizer head assembly of Aspect 1, wherein the plurality of pores of the porous diffuser plate comprises at least 20% of a surface area of a portion of the porous diffuser plate surrounding the apertures.

Aspect 3 of the description is:

The oxidizer head assembly of Aspect 1 or 2, wherein each of the plurality of pores comprises a diameter of at least 1.50 millimeters.

Aspect 4 of the description is:

The oxidizer head assembly of any of Aspects 1-3, wherein the plurality of pores comprises a pore pitch of at least 3.00 millimeters.

Aspect 5 of the description is:

The oxidizer head assembly of any of Aspects 1-4, further comprising a temperature detector extending through the oxidizer head assembly.

Aspect 6 of the description is:

The oxidizer head assembly of any of Aspects 1-5, further comprising a pilot assembly comprising an ignition component extending through the oxidizer head assembly.

Aspect 7 of the description is:

An abatement system comprising:

an oxidizer head assembly comprising:

a head body defining:

an inlet flange;

an outlet flange positioned opposite the inlet flange; and a wall extending between the inlet flange and the outlet flange, wherein the inlet flange, the outlet flange, and the wall define a cavity positioned between the inlet flange and the outlet flange, the cavity being bounded by the inlet flange and the wall and defining an outlet opening defined by the outlet flange;

a plurality of nozzles extending through the cavity between the inlet flange and the outlet flange;

a fuel inlet in communication with the plurality of nozzles;

a shield gas inlet in communication with the cavity; and a porous diffuser plate extending across the outlet opening, the porous diffuser plate comprising apertures for the plurality of nozzles and a plurality of pores, wherein a shield gas passes through the shield gas inlet, through the cavity, and through the plurality of pores of the porous diffuser plate around the plurality of nozzles and a fuel passes through the plurality of nozzles;

a burner plenum coupled to the outlet flange and in communication with the oxidizer head assembly, the burner plenum defining a burner cavity; and an oxidizer gas inlet coupled to and in communication with the burner plenum, wherein a process gas passes through the oxidizer gas inlet and the plurality of nozzles into the burner. plenum.

Aspect 8 of the description is:

The abatement system of Aspect 7, further comprising a plenum inlet in communication with the burner plenum, wherein a combustion gas is passed through the plenum inlet to the burner plenum, and a volumetric flow of the combustion gas and the process gas is maintained at a predetermined volumetric flow.

Aspect 9 of the description is:

The abatement system of Aspect 7 or 8, further comprising:

a quench chamber coupled to and in communication with the burner plenum; and a cooling air inlet in communication with the quench chamber, wherein cooling air is passed through the cooling air inlet to the quench chamber.

Aspect 10 of the description is:

The abatement system of Aspect 9, wherein the cooling air inlet defines an exhaust outlet spaced apart from the burner plenum.

Aspect 11 of the description is:

The abatement system of any of Aspects 7-10, wherein the plurality of pores of the porous diffuser plate comprise at least 20% of a surface area of a portion of the porous diffuser plate surrounding the apertures.

Aspect 12 of the description is:

The abatement system of any of Aspects 7-11, wherein each of the plurality of pores comprises a diameter of at least 1.50 millimeters.

Aspect 13 of the description is:

The abatement system of any of Aspects 7-12, wherein the plurality of pores comprises a pore pitch that is at least 3.00 millimeters.

Aspect 14 of the description is:

The abatement system of any of Aspects 7-13, wherein the plurality of nozzles extends through the porous diffuser plate.

Aspect 15 of the description is:

The abatement system of any of Aspects 7-14, further comprising a temperature detector extending through the oxidizer head assembly to the burner plenum.

Aspect 16 of the description is:

The abatement system of any of Aspects 7-15, further comprising a pilot assembly comprising an ignition component extending through the oxidizer head assembly to the burner plenum.

Aspect 17 of the description is:

A method for abating silicon tetrafluoride, the method comprising:

passing a process gas comprising silicon tetrafluoride into a burner plenum;

passing a fuel through a plurality of nozzles that extend through a cavity of an oxidizer head assembly and through a porous diffuser plate;

passing a shield gas through the cavity of the oxidizer head assembly and through a plurality of pores of the porous diffuser plate; and combusting the fuel and the process gas to form resultants comprising hydrogen fluoride and silicon dioxide.

Aspect 18 of the description is:

The method of Aspect 17, wherein passing the shield gas through the plurality of pores of the porous diffuser plate comprises biasing the silicon dioxide away from the porous diffuser plate.

Aspect 19 of the description is:

The method of Aspect 17 or 18, further comprising detecting a temperature of the burner plenum with a temperature detector positioned at least partially in the burner plenum.

Aspect 20 of the description is:

The method of Aspect 19, wherein passing the shield gas through the plurality of pores of the porous diffuser plate comprises biasing the silicon dioxide away from the temperature detector.

Aspect 21 of the description is:

The method of any of Aspects 17-20, wherein the shield gas comprises an inert gas.

Aspect 22 of the description is:

The method of any of Aspects 17-21, further comprising passing the resultants from the burner plenum to a quench chamber coupled to and in communication with the burner plenum.

Aspect 23 of the description is:

The method of Aspect 22, further comprising cooling the resultants with a cooling air in the quench chamber.

Aspect 24 of the description is:

The method of any of Aspects 17-23, further comprising passing a combustion gas into the burner plenum.

Aspect 25 of the description is:

The method of Aspect 24, further comprising detecting a volumetric flow of the process gas into the burner plenum.

Aspect 26 of the description is:

The method of Aspect 25, further comprising, in response to detecting a decrease in the volumetric flow of the process gas, increasing a volumetric flow of the combustion gas into the burner plenum.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. An oxidizer head assembly comprising:

a head body defining:

an inlet flange;

an outlet flange positioned opposite the inlet flange; and a wall extending between the inlet flange and the outlet flange, wherein the inlet flange, the outlet flange, and the wall define a cavity positioned between the inlet flange and the outlet flange, the cavity being bounded by the inlet flange and the wall and defining an outlet opening at the outlet flange;

a plurality of nozzles extending through the cavity between the inlet flange and the outlet flange and through the outlet opening;

a fuel inlet in communication with the plurality of nozzles, wherein a fuel passes through the fuel inlet and the plurality of nozzles;

a shield gas inlet in communication with the cavity; and a porous diffuser plate extending across the outlet opening, the porous diffuser plate comprising apertures for the plurality of nozzles and a plurality of pores, wherein a shield gas passes through the shield gas inlet, through the cavity, and through the plurality of pores of the porous diffuser plate around the plurality of nozzles.

2. The oxidizer head assembly of claim 1, wherein the plurality of pores of the porous diffuser plate comprises at least 20% of a surface area of a portion of the porous diffuser plate surrounding the apertures.

3. The oxidizer head assembly of claim 1, wherein each of the plurality of pores comprises a diameter of at least 1.50 millimeters.

4. The oxidizer head assembly of claim 1, wherein the plurality of pores comprises a pore pitch of at least 3.00 millimeters.

5. The oxidizer head assembly of claim 1, further comprising a temperature detector extending through the oxidizer head assembly.

6. The oxidizer head assembly of claim 1, further comprising a pilot assembly comprising an ignition component extending through the oxidizer head assembly.

7. An abatement system comprising:

an oxidizer head assembly comprising:

a head body defining:

an inlet flange;

an outlet flange positioned opposite the inlet flange; and a wall extending between the inlet flange and the outlet flange, wherein the inlet flange, the outlet flange, and the wall define a cavity positioned between the inlet flange and the outlet flange, the cavity being bounded by the inlet flange and the wall and defining an outlet opening defined by the outlet flange;

a plurality of nozzles extending through the cavity between the inlet flange and the outlet flange;

a fuel inlet in communication with the plurality of nozzles;

a shield gas inlet in communication with the cavity; and a porous diffuser plate extending across the outlet opening, the porous diffuser plate comprising apertures for the plurality of nozzles and a plurality of pores, wherein a shield gas passes through the shield gas inlet, through the cavity, and through the plurality of pores of the porous diffuser plate around the plurality of nozzles and a fuel passes through the plurality of nozzles;

a burner plenum coupled to the outlet flange and in communication with the oxidizer head assembly, the burner plenum defining a burner cavity; and an oxidizer gas inlet coupled to and in communication with the burner plenum, wherein a process gas passes through the oxidizer gas inlet and the plurality of nozzles into the burner plenum.

8. The abatement system of claim 7, further comprising a plenum inlet in communication with the burner plenum, wherein a combustion gas is passed through the plenum inlet to the burner plenum, and a volumetric flow of the combustion gas and the process gas is maintained at a predetermined volumetric flow.

9. The abatement system of claim 7, further comprising:

a quench chamber coupled to and in communication with the burner plenum; and a cooling air inlet in communication with the quench chamber, wherein cooling air is passed through the cooling air inlet to the quench chamber.

10. The abatement system of claim 7, wherein the plurality of pores of the porous diffuser plate comprise at least 20% of a surface area of a portion of the porous diffuser plate surrounding the apertures.

11. The abatement system of claim 7, wherein each of the plurality of pores comprises a diameter of at least 1.50 millimeters.

12. The abatement system of claim 7, wherein the plurality of pores comprises a pore pitch that is at least 3.00 millimeters.

13. The abatement system of claim 7, wherein the plurality of nozzles extends through the porous diffuser plate.

14. The abatement system of claim 7, further comprising a temperature detector extending through the oxidizer head assembly to the burner plenum.

* * * * *